US011678747B2

(12) United States Patent
Signarsson et al.

(10) Patent No.: US 11,678,747 B2
(45) Date of Patent: Jun. 20, 2023

(54) SITTING FURNITURE

(71) Applicant: NATIVE BIONICS SCANDINAVIA AB, Stockholm (SE)

(72) Inventors: Mikael Signarsson, Upplands Vasby (SE); Erik Lidén, Tyreso (SE); Martin Bolter, Akersberga (SE); Martin Kramberg, Upplands Vasby (SE)

(73) Assignee: NATIVE BIONICS SCANDINAVIA AB, Stockholm (SE)

( * ) Notice: Subject to any disclaimer, the term of this patent is extended or adjusted under 35 U.S.C. 154(b) by 0 days.

(21) Appl. No.: 17/057,342

(22) PCT Filed: May 22, 2019

(86) PCT No.: PCT/SE2019/050470
§ 371 (c)(1),
(2) Date: Nov. 20, 2020

(87) PCT Pub. No.: WO2019/226112
PCT Pub. Date: Nov. 28, 2019

(65) Prior Publication Data

US 2021/0219732 A1 Jul. 22, 2021

(30) Foreign Application Priority Data

May 22, 2018 (SE) ..... 1850599-0

(51) Int. Cl.
*A47C 9/00* (2006.01)
*A47C 1/034* (2006.01)
*A47C 7/50* (2006.01)

(52) U.S. Cl.
CPC ..... *A47C 9/005* (2013.01); *A47C 1/034* (2013.01); *A47C 7/50* (2013.01)

(58) Field of Classification Search
CPC ..... A47C 9/005; A47C 16/04; A47C 9/027
(Continued)

(56) References Cited

U.S. PATENT DOCUMENTS 4,650,249 A * 3/1987 Serber ..... A47C 9/005 248/397
4,746,167 A * 5/1988 Palmer ..... A47C 9/005 297/195.11
(Continued)

FOREIGN PATENT DOCUMENTS

CN 201403845 Y 2/2010
CN 201668143 U 12/2010
(Continued)

OTHER PUBLICATIONS

International Search Report from corresponding International Application No. PCT/SE2019/050470, dated Jun. 17, 2019, 4 pages.
(Continued)

*Primary Examiner* — Sarah B McPartlin
(74) *Attorney, Agent, or Firm* — Tucker Ellis LLP

(57) ABSTRACT

Sitting furniture (100) comprising a seat (110), a lower leg support (120) and a chest support (130). The invention is characterised in that the seat (110) is arranged to support the posterior thigh (11) and/or buttocks (12) of a seated user (10) such that the femur bone (13) of the seated user (10) is downwards inclined in the anterior direction at an angle of at least 40° downwards in relation to the horizontal, in that the lower leg support (120) is arranged to support the anterior side of the lower legs (14) of the seated user (10), and in that the chest support (130) is arranged to support the chest (15) of the seated user (10) in a forward leaning position of the seated user (10) such that the third lumbar vertebrae body (16) of the seated user (10) is arranged in a support plane (150), which support plane (150) is perpendicular to the sagittal plane of the user and in which support plane (150) the respective pivot point (17) of the seated user's (10) hip joints and the respective pivot point (18) of the seated user's (10) shoulder joints are also arranged when
(Continued)

Figure 1A:
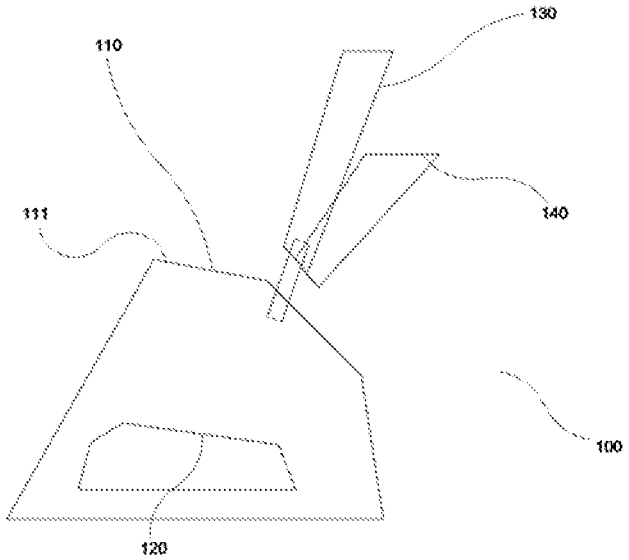

the posture of the seated user (10) is symmetric about the seated user's (10) sagittal plane.

15 Claims, 6 Drawing Sheets

(58) Field of Classification Search
USPC ..... 297/423.11
See application file for complete search history.

(56) References Cited

U.S. PATENT DOCUMENTS

| | | | | |
|---|---|---|---|---|
| 4,832,407 | A | 5/1989 | Serber | |
| 4,943,117 | A * | 7/1990 | Brown | A47C 9/005 5/632 |
| 6,298,508 | B1 * | 10/2001 | McCloskey | A47C 9/005 |
| 7,320,502 | B1 * | 1/2008 | McCloskey | A47C 16/04 297/DIG. 6 |
| 2007/0052275 | A1 * | 3/2007 | Ghilzai | A47C 1/11 297/423.12 |
| 2008/0272628 | A1 * | 11/2008 | Lazar | A47B 97/00 297/118 |

FOREIGN PATENT DOCUMENTS

| | | | |
|---|---|---|---|
| KR | 20050109120 | A | 11/2005 |
| WO | 8606940 | A1 | 12/1986 |
| WO | 2008085174 | A1 | 7/2008 |

OTHER PUBLICATIONS

International Preliminary Report on Patentability from corresponding International Application No. PCT/SE2019/050470, dated Aug. 20, 2020, 23 pages.
Office Action from corresponding European Application No. 19806957.7, dated Apr. 14, 2023, 7 pages.

* cited by examiner

SITTING FURNITURE

The present invention relates to sitting furniture, and in particular to a chair. More particularly, the present invention relates to a chair for use when performing work, a gaming activity, a creative activity, or in any other circumstance when using some type of stationary equipment or device. For instance, the present chair is useful as a gaming chair, an office chair or an artist's chair. The present invention is particularly useful for computer use, and in particular in combination with a screen display which is viewed by a user of the chair.

In the following, the present invention and its advantages will be described in the context of such computer use. However, it is noted that the invention finds equal utility in corresponding fields of use, such as for general office work, writing, handicraft work or in simulators of different types.

It is well-known that prolonged sitting in ergonomically non-optimal positions can potentially lead to physical injury. In particular, the neck is exposed to such injury, for instance as a result of the head of a sitting person being bent forward and downward, in turn leading to muscle tension and related issues.

There have been numerous proposals for ergonomic sitting furniture. For instance, conventional office chairs come with a multitude of configuration possibilities, regarding seat height and angle, back support, suspension, and so forth. There are sitting furniture with an imbalance which is built-in on purpose, such as having only one leg or being supported on a non-stable foundation forcing the user to actively use core muscles to continuously balance the sitting position. There are chairs with no back rest, forcing the user to assume a correct upright position when sitting. There are even chairs featuring a chest support instead of a back support, allowing the user to lean forward rather than backward.

However, there are still problems with conventional sitting furniture. Many times, they are perceived as not comfortable enough for prolonged use, leading to users not continuing to use them. Also, they are often unable to provide the ergonomic benefits they are supposed to, either because the sitting position in practise will be less than optimal despite its good intentions or because users don't use them as intended.

Another problem with conventional sitting furniture is that they do not always encourage an "offensive" or "active" sitting position. A laidback, "passive" or "inactive", sitting position, or one in which the user is required to keep a certain non-desired muscle tension, will in general not provide an optimal user cognitive experience. When assuming a correct, forward-leaning and "active" sitting position, the sitting user will feel more active. It is even so that such "offensive" sitting positions will potentially lead to improved reaction times and a more active cognitive engagement with the task performed. This is in particular important for gaming, when the small margins encountered in many situations may make this the difference between winning and losing.

The present invention solves the above described problems, providing a sitting furniture offering an ergonomically correct yet offensive sitting position. The sitting furniture of the invention can also be manufactured in an efficient way from standard materials and be aesthetically appealing.

Hence, the invention relates to a piece of sitting furniture comprising a seat, a lower leg support and a chest support, which piece of sitting furniture is characterised in that the seat is arranged to support the posterior thigh and/or buttocks of a seated user such that the femur bone of the seated user is downwards inclined in the anterior direction at an angle of at least 40° downwards in relation to the horizontal, in that the lower leg support is arranged to support the anterior side of the lower legs of the seated user, and in that the chest support is arranged to support the chest of the seated user in a forward leaning position of the seated user such that the third lumbar vertebrae body of the seated user is arranged in a support plane, which support plane is perpendicular to the sagittal plane of the user and in which support plane the respective pivot point of the seated user's hip joints and the respective pivot point of the seated user's shoulder joints are also arranged when the posture of the seated user is symmetric about the seated user's sagittal plane.

Figure 1B:
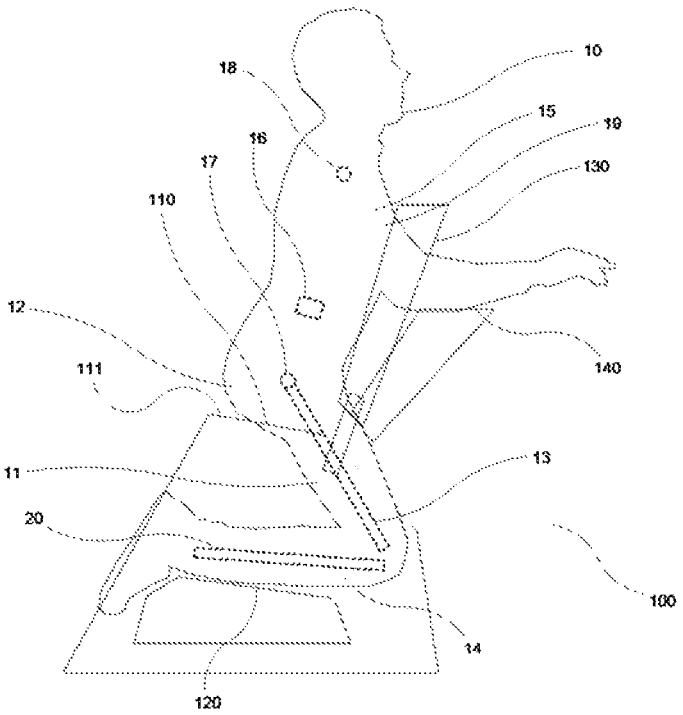
Figure 1C:
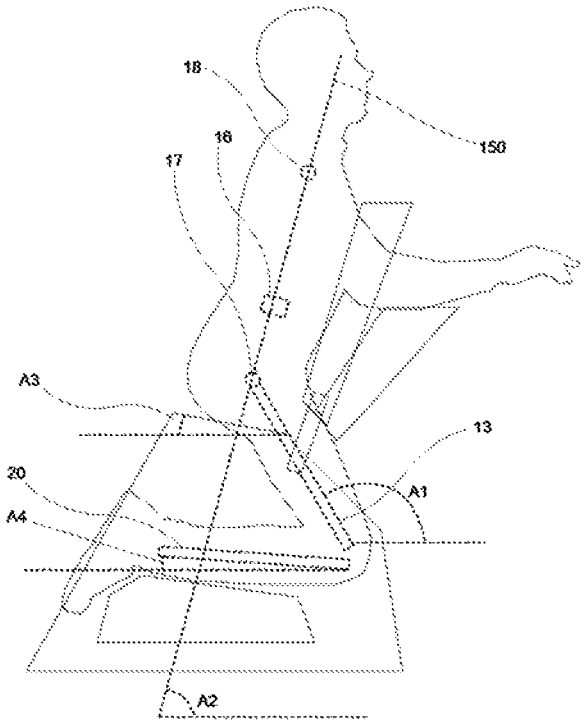
Figure 2A:
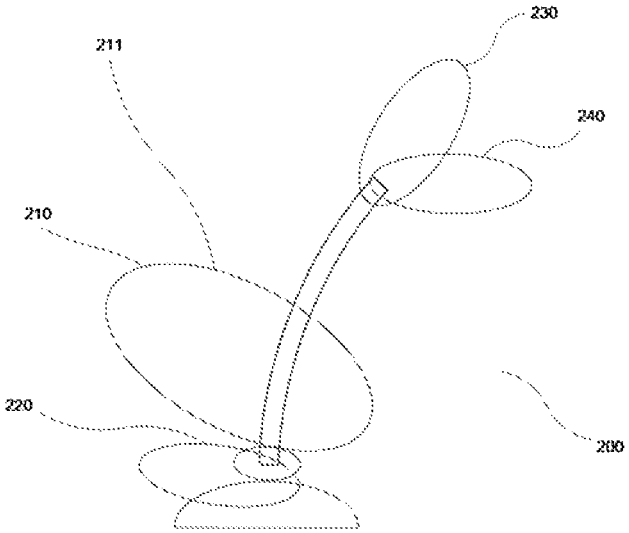
Figure 2B:
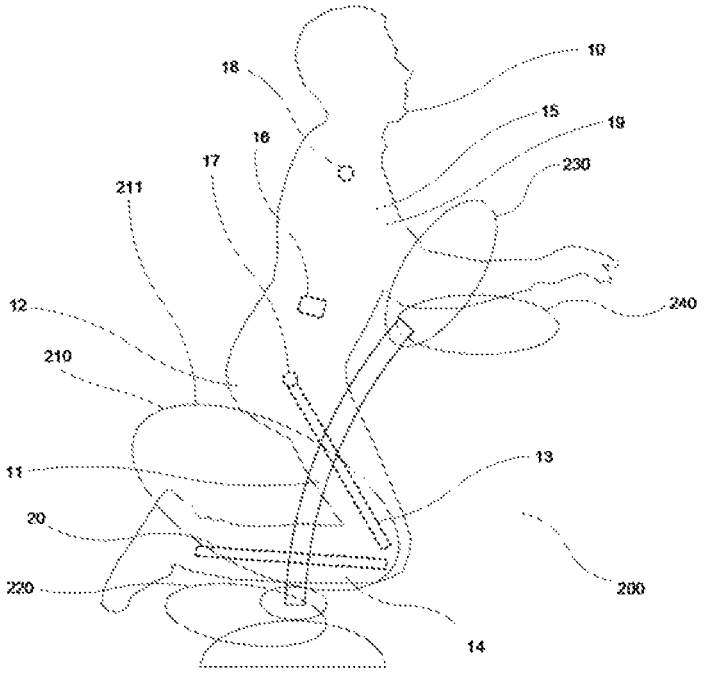
Figure 2C:
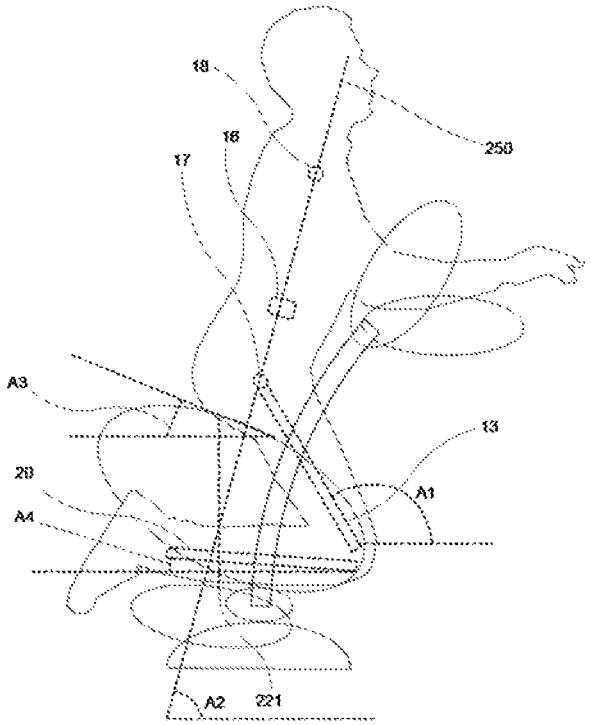
Figure 3A:
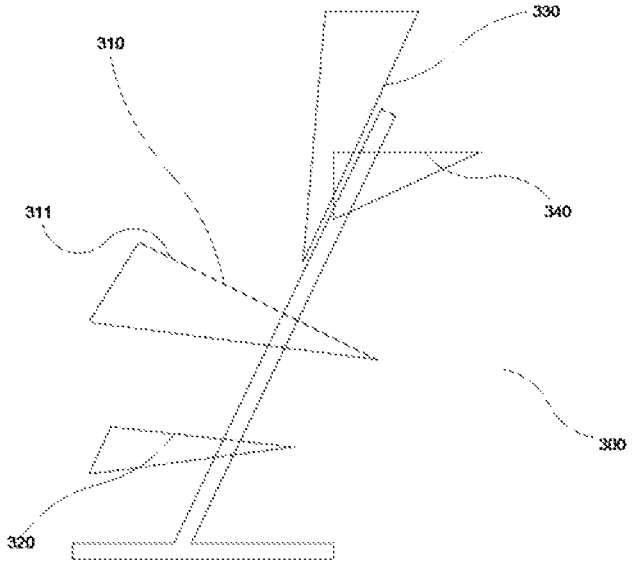
Figure 3B:
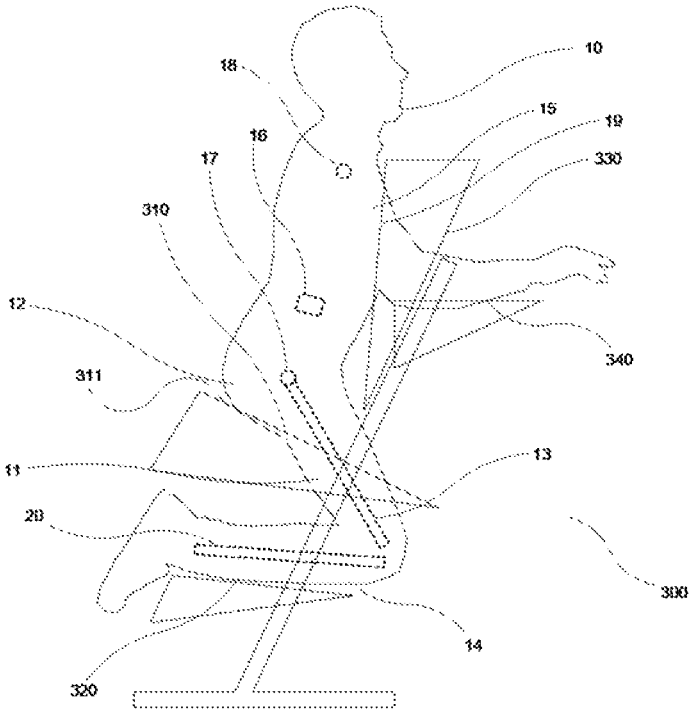
Figure 3C:
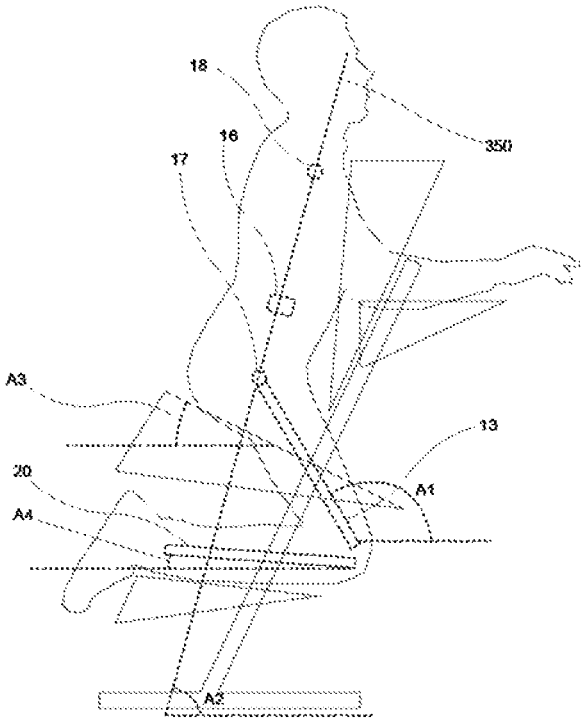
Figure 4A:
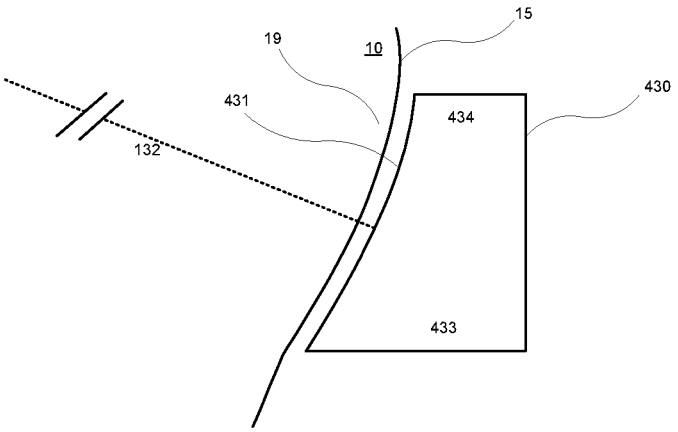
Figure 4B:
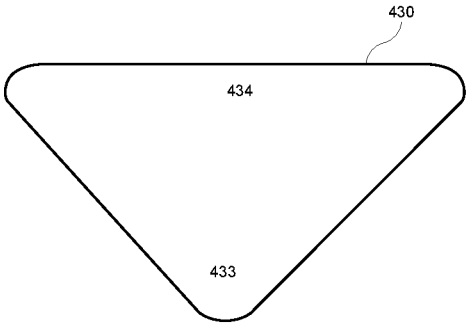
Figure 5:
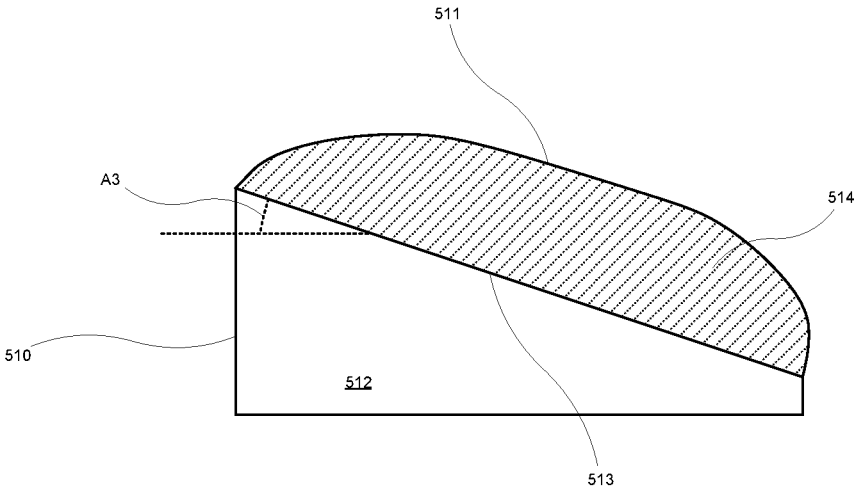

In the following, the invention will be described in detail, with reference to exemplifying embodiments of the invention and to the enclosed drawings, wherein:

FIG. 1*a* is a schematic side view of a sitting furniture according to a first exemplifying embodiment the present invention;

FIG. 1*b* shows the sitting furniture of FIG. 1*a* with a person sitting thereon;

FIG. 1*c* shows the sitting furniture and person shown in FIG. 2*b* and also with certain angles according to the present invention;

FIGS. 2*a*-2*c* correspond to FIGS. 1*a*-1*c*, but for a second exemplifying embodiment of the present invention;

FIGS. 3*a*-3*c* also correspond to FIGS. 1*a*-1*c*, but for a third exemplifying embodiment of the present invention;

FIG. 4*a* is a detail side view of a chest support of a piece of sitting furniture according to the present invention;

FIG. 4*b* is a detail view of the chest support illustrated in FIG. 4*a*, but as seen from the front of a seated user; and FIG. 5 is a detail side view of a seat of a piece of sitting furniture according to the invention.

In all the Figures, the same last two digits in each reference numeral are used to denote the same or corresponding details. The Figures are not necessarily drawn to scale.

Hence, FIGS. 1*a*, 2*a* and 3*a* illustrate, in a respective simplified side view, three different exemplifying embodiments of a piece of sitting furniture 100, 200, 300 according to the present invention. The piece of sitting furniture 100, 200, 300 comprises a seat, 110, 210, 310, a lower leg support 120, 220, 320 and a chest support 130, 230, 330.

FIGS. 1*b*, 2*b* and 3*b* illustrate the same respective sitting furniture 100, 200, 300 with a seated user 10. In the Figures, the user 10 is illustrated in a seated position, in which the user sits in an ergonomically favourable position made possible by the specific geometric constitution of the piece of sitting furniture 100, 200, 300 in question, as will be explained in the following.

In particular, the seat 110, 210, 310 is arranged to support the posterior thigh 11 and/or the buttocks 12 of the seated user 10 such that the femur bone 13 of the seated user 10 is downwards inclined in the anterior direction at an angle A1 of at least 40° downwards in relation to the horizontal. This is best illustrated in FIGS. 1*c*, 2*c* and 3*c* in which the various angles described herein are illustrated. This femur bone position and inclination may, for instance, be achieved by the seat 110, 210, 310 being inclined as described below and the relative geometric arrangement between the seat 110, 210, 310, the lower leg support 120, 220, 320 and/or the chest support 130, 230, 330.

Furthermore, the lower leg support 120, 220, 320 is arranged to support the anterior side of the lower legs 14 of the seated user 10, whereas the chest support 130, 230, 330 is arranged to support the chest 15 of the seated user 10 in a forward leaning position of the user 10 illustrated in FIGS. 1*b*, 1*c*, 2*b*, 2*c*, 3*b*, 3*c*. This forward leaning position results from the user 10 sitting down onto the piece of sitting furniture 100, 200, 300, as a consequence of the combined geometry of the seat 110, 210, 310, the lower leg support 120, 220, 320 and the chest support 130, 230, 330 in relation one to the other. Hence, the piece of sitting furniture 100, 200, 300 is arranged to encourage or even force the user 10 to assume said forward leaning position when seated in the piece of sitting furniture 100, 200, 300 by the relative geometric arrangement of its constituent parts. In order to achieve this, it is preferred that the seat 110, 120, 130, the lower leg support 120, 220, 320 and the chest support 130, 230, 330 are fixedly arranged in relation to each other, such as via metal bars or in any other suitable manner. In other words, the supports points are preferably fixedly arranged one in relation to the other in space.

It is important that the seated user 10, when in said forward leaning position, is oriented such that the third lumbar vertebrae body 16 of the seated user 10 is arranged in a support plane 150, 250, 350 illustrated in FIGS. 1*c*, 2*c* and 3*c*, which support plane 150, 250, 350 is perpendicular to the sagittal plane of the seated user 10. Hence, the support plane 150, 250, 350 is perpendicular to the paper in FIGS. 1*c*, 2*c* and 3*c*.

Furthermore, the respective pivot point 17 of the seated user's 10 hip joints and the respective pivot point 18 of the seated user's 10 shoulder joints are also arranged in the said support plane 150, 250, 350 when the posture of the seated user 10 is symmetric about the sagittal plane of the seated user 10 in the forward leaning position. This property of the forward leaning position is achieved by a combination of the position and angle of the seated user's 10 femur bone 13 and the location of the chest support 130, 230, 330 point.

It is understood that in FIGS. 1*c*, 2*c*, 3*c* the sagittal plane of the seated user 10 is parallel to the paper, resulting in that the said pivot points 17, 18 are both located on top of each other in FIGS. 1*c*, 2*c*, 3*c*. However, according to the present invention, both the two hip joint pivot points 17, both the two shoulder joint pivot points 18 and the body of the third lumbar vertebrae are arranged in said support plane 150, 250, 350 when the seated user 10 is positioned in said forward leaning position supported by the piece of sitting furniture 100, 200, 300.

The present inventors have discovered that a piece of sitting furniture which, due to its relative geometric positioning of the different support structures 110, 120, 130; 210, 220, 230; 310, 320, 330, results in a seated user 10 assuming the above described position, with the support plane 150, 250, 350 in which the said anatomic details 16, 17, 18 are located, provides an ergonomically very advantageous sitting experience. The seated user 10 can relax fully while maintaining very low levels of destructive tension and at the same time keeping an active position in turn resulting in increased attention on the task at hand.

In particular, it is preferred for ergonomic reasons that the forward leaning position is such that the femur bone 13 of the seated user 10 is downwards inclined in the user's anterior direction, at an angle A1 of at least 25°, and at the most 40°, downwards in relation to the horizontal.

In an ergonomically preferred embodiment, the said support plane 150, 250, 350 is inclined at an angle A2 of at least 65°, preferably at least 70°, and at the most 85°, preferably at the most 80°, in relation to the horizontal.

Furthermore, the present inventors have discovered that the above described positive ergonomic effects are achieved more efficiently in the preferred case in which the piece of sitting furniture 10 does not include a head support. This is illustrated in FIGS. 1*a*-3*c*, in which the sitting furniture 100, 200, 300 does not include a head support. Such head supports may, for instance, be neck, jaw, temple or forehead supports. Preferably, the head of the seated user 10 is completely unsupported, so that the seated user 10 is required to balance his or her head completely on his or her own. Given the orientation of the seated user 10 in the above described support plane 150, 250, 350, the balancing of the head will in general then result in the user orienting his or her head so that the gaze of the seated user 10 is oriented horizontally, in turn yielding an ergonomically favourable seating position of the user 10 provided the forward leaning position described herein.

FIG. 4*a* illustrates, in more detail, an exemplifying chest support 430, corresponding to chest supports 130, 230, 330 illustrated in FIGS. 1*a*-3*c*. According to the invention, the chest support 430 is associated with (comprises a surface with) a concave shape 431, arranged to be complementary to a corresponding convex shape of the seated user's 10 chest 15, and in particular to the convex shape of the seated user's 10 chest 15 when the seated user 10 in question is oriented along said support plane 450 as described above, in the forward leaning position. Such a concave shape 431, in combination with the orientation of the above-described supporting parts 110, 120, 130; 210, 220, 230; 310, 320, 330 of the sitting furniture 100, 200, 300, hence encourages, or even forces, the seated user 10 to assume said forward leaning position along the support plane 450 as described above. The concave shape 431 may be a developable or a non-developable surface.

In particular, the said concave shape 431 comprises a concave curvature, in a vertical cross-sectional plane which preferably is the seated user's sagittal plane, which concave curvature has a radius of curvature 432 of between 2 and 3 meters.

Furthermore, the chest support 430 is preferably at least 20 cm, more preferably at least 40 cm, wide (in a horizontal direction perpendicularly to the paper in FIG. 4*a*) at a height corresponding to the seated user's 10 pectoralis 19.

Further preferably, the chest support 430 is at least twice as narrow at a lower part 433 of the chest support 430 as compared at an upper part 434 of the chest support 430. Hence, the chest support 430 may preferably be roughly formed, when viewed from the front of the seated user 10, as a triangle with one corner pointing downwards and the other corners pointing to either horizontal side. This is illustrated in FIG. 4*b*, showing a simplified view of the exemplifying chest support 430 as viewed from the front of the seated user 10.

FIG. 5 illustrates, in a simplified side view, a seat 510 according to the invention, including an inclined seating surface 511. This inclined seating surface 511 corresponds to respective inclined seating surfaces 111, 211, 311 as illustrated in corresponding respective seats 110, 210, 310 in FIGS. 1*a*-1*c*; 2*a*-2*c*; and 3*a*-3*c*.

The buttocks 12 and/or posterior thigh 11 of the seated user 10 are preferably supported on the seat 510 at a non-zero angle A3, in relation to the horizontal. The angle A3 may be defined by the inclined seating surface 111, 211, 311, this being a rigid surface. This is illustrated in seating furniture 100, 200, 300. However, as is illustrated in FIG. 5, the seating surface 511 may be a soft or resilient, non-rigid, seating surface 511.

In this case, the seat 510 may comprise a rigid support layer 512, in turn covered with a non-rigid layer 514 supporting said non-rigid inclined seating surface 511. In particular, the non-rigid support layer 512 may advantageously comprise a granulate material and/or a gel material, which non-rigid material may be arranged in a thickness of at least 3 cm across the surface supporting the seated user 10. The rigid support layer 512 may then, in turn, comprise a rigid support surface 513 defining the angle A3.

The granular and/or gel material may be arranged in a plurality of individually sealed compartments across a rigid support surface 513.

Such a granular or gel material is preferably arranged so that the seated user 10 is softly supported, but in a way so that the buttocks 12 or posterior thigh 11 of the seated user 10 do not slide down along the seat 510 when the user 10 sits in said forward leaning position. To achieve this goal, the present inventors have realized that a relatively thick layer of granular and/or gel material achieves this for the general sitting furniture geometries described herein.

Hence, the angle A3 determines the angle of the rigid support ultimately supporting the buttocks 12 or posterior thigh 11 of the seated user 10, and therefore also impacts the position of the seated user 10, such as the femur bone 13, in said forward leaning position.

In particular, it is preferred that the rigid support surface 513, or the rigid seating surface 111, 211, 311, as the case may be, is inclined forwards and downwards (in relation to the seated user 10) at the angle A3 of between 50° and 65° to the horizontal.

In general, in the forward leaning position, it is preferred that the majority of the seated user's 10 weight is supported by the seat 110, 210, 310, 510, as opposed to by the lower leg support 120, 220, 320 or the chest support 130, 230, 330, 430. This is achieved by the relative geometric arrangements between these parts, as described herein and as exemplified in the Figures.

Preferably, the sitting furniture 100, 200, 300 does not comprise any other seated user 10 load-supporting details, apart from the seat 110, 210, 310, 510; the lower leg support 120, 220, 320; and the chest support 130, 230, 330, that are in use for supporting the seated user 10 in said forward leaning position.

Regarding the lower leg support 120, 220, 320, it is preferred that this part is arranged in such a way so that the lower legs 14 of the seated user 10 are oriented substantially horizontally, further preferably so that the tibia 20 of the seated user 10 is inclined at a non-zero angle A4 upwards from the user's 10 knee and backwards in the forward leaning position, in relation to the horizontal, which angle A4 may preferably be between 0° and 10° upwards from the user's 10 knee in relation to the horizontal.

Furthermore, the lower leg support 120, 220, 320 is arranged to support the lower legs 14 of the seated user 10 at a point 221 (see FIG. 2*c*) which is vertically arranged below a point at which the seat 110, 210, 310, 510 supports the seated user 10, in a projection onto the seated user's sagittal plane. Hence, the seated user 10 is supported at the seat 110, 210, 310, 510 as well as at the lower leg support 120, 220, 320, which support points lie vertically one to the other in the user's sagittal plane. Of course, the lower leg support 120, 220, 320 may comprise two lower leg support parts, each one arranged to support a respective lower leg 14 of the seated user 10 on either transverse side of the sagittal plane of the seated user 10.

Furthermore, the sitting furniture 100, 200, 300 may further comprises arm rests 140, arranged to support the elbows or lower arms of the seated user 10, when in said forward leaning position, at a height and in a position of the seated user 10 in which the seated user's 10 shoulders are relaxed. Preferably, the upper arms of the seated user 10 may then be vertical or slightly forward downwards inclined. The lower arms of the seated user 10 are then preferably substantially horizontally arranged. In this position, operation of a keyboard, a computer mouse or similar is possible in an ergonomically sound way.

Above, preferred embodiments have been described. However, it is apparent to the skilled person that many modifications can be made to the disclosed embodiments without departing from the basic idea of the invention.

In general, all the embodiments described above can be combined in any way, as applicable.

The sitting furniture 100, 200, 300 may comprise many other design features apart from the ones described above and illustrated in the Figures, as long as the principles described herein, concerning the forward leaning position of the seated user 10, are respected.

In particular, the sitting furniture 100, 200, 300 may be adjustable in various ways, so as to be adapted to users 10 of various lengths, weights and other constitutions.

The sitting furniture 100, 200, 300 may also comprise paddings and other features improving sitting comfort.

Hence, the invention is not limited to the described embodiments, but can be varied within the scope of the enclosed claims.

The invention claimed is:

1. A sitting furniture having a vertical axis and a horizontal axis perpendicular to the vertical axis, the horizontal axis extending from a rear of the sitting furniture to a front of the sitting furniture, the sitting furniture comprising:

a seat comprising a rigid support surface having a buttocks support portion, the buttocks support portion inclined downward from the rear of the sitting furniture toward the front of the sitting furniture relative to the horizontal axis;

a lower leg support comprising a shin support surface portion located vertically below the buttocks support portion such that a line drawn through the shin support surface portion and a mid-point of the buttocks support portion is parallel the vertical axis, the shin support surface portion inclined downward from the rear of the sitting furniture toward the front of the sitting furniture relative to the horizontal axis; and a chest support having a chest support portion, the chest support portion positioned, relative to the rear and the front of the sitting furniture, forward of the buttocks support portion.

2. The sitting furniture of claim 1, wherein the seat further comprises a resilient seating surface on top of the rigid support surface.

3. The sitting furniture of claim 2, wherein the resilient seating surface comprises a layer of at least one of a granulate material or a gel material.

4. The sitting furniture of claim 1, wherein the chest support portion is inclined upward relative to the horizontal axis from the rear of the sitting furniture toward the front of the sitting furniture and wherein a line drawn through the chest support portion at the incline thereof extends rearwardly and downwardly toward the shin support surface portion and in front of the buttocks support portion.

5. The sitting furniture of claim 1, wherein the sitting furniture does not include a head support.

6. The sitting furniture of claim 1, wherein the seat, the lower leg support, and the chest support are fixedly arranged in relation to one another.

7. The sitting furniture of claim 1, wherein the sitting furniture further comprises arm rests.

8. The sitting furniture of claim 1, wherein the chest support portion has a concave shape in a vertical cross-sectional plane.

9. The sitting furniture of claim 8, wherein the concave shape has a radius of curvature of between 2 and 3 meters.

10. The sitting furniture of claim 1, wherein the chest support portion is at least twice as narrow at a lower part of the chest support portion as compared to at an upper part of the chest support portion.

11. The sitting furniture of claim 1, wherein the buttocks support portion is inclined downward at an angle between 50° and 65°.

12. The sitting furniture of claim 1, wherein the chest support portion is inclined upward relative to the horizontal axis from the rear of the sitting furniture toward the front of the sitting furniture.

13. The sitting furniture of claim 1, wherein, for a seated user of coordinating body size to the sitting furniture:

the seat supports the posterior thigh and buttocks of the seated user such that the femur bone of the seated user is downwards inclined in an anterior direction downwards in relation to the horizontal axis, the lower leg support supports the anterior side of the lower legs of the seated user, the chest support restricts forward positioning of the chest of the seated user, and the seat, the lower leg support, and the chest support together orient the seated user so that the third lumbar vertebrae, pivot points of the seated user's hip joints, and pivot points of the seated user's shoulder joints are each in a support plane perpendicular to the sagittal plane of the seated user, the support plane inclined at least 65° in relation to the horizontal axis.

14. The sitting furniture of claim 13, wherein the seat supports the posterior thigh and buttocks of the seated user such that the femur bone of the seated user is downwards inclined in the anterior direction at an angle of at least 40° downwards in relation to the horizontal axis.

15. The sitting furniture of claim 13, wherein the seat, the lower leg support, and the chest support together further orient the lower legs of the seated user so that the tibia of the seated user is inclined between 0° and 10° upwards from the knee of the seated user, in relation to the horizontal axis.

* * * * *